United States Patent [19]

Willibey et al.

[11] Patent Number: 4,960,349

[45] Date of Patent: Oct. 2, 1990

[54] WOVEN GEOTEXTILE GRID

[75] Inventors: Gary L. Willibey, Dunwoody; John W. Hawkins, Stone Mountain; Russell P. Harp, Lithia Springs; David M. Wilkinson, Stone Mountain, all of Ga.

[73] Assignees: Nicolon Corporation, Norcross; Georgia Duck and Cordage Mill, Scottdale, both of Ga.

[21] Appl. No.: 387,653

[22] Filed: Jul. 31, 1989

Related U.S. Application Data

[62] Division of Ser. No. 280,123, Dec. 5, 1988.

[51] Int. Cl.[5] ..... E02D 29/02

[52] U.S. Cl. ..... 405/262; 405/258; 405/284

[58] Field of Search ..... 405/258, 262, 284, 285, 405/286, 287

[56] References Cited

U.S. PATENT DOCUMENTS

| | | | |
|---|---|---|---|
| 1,762,343 | 6/1930 | Munster . | |
| 2,742,391 | 4/1956 | Warp . | |
| 3,142,109 | 7/1964 | Stoll et al. . | |
| 3,421,326 | 1/1969 | Vidal . | |
| 3,623,937 | 11/1971 | Gasaway . | |
| 3,686,873 | 8/1972 | Vidal | 405/262 |
| 4,116,010 | 9/1978 | Vidal . | |
| 4,116,743 | 9/1978 | Davis . | |
| 4,117,686 | 10/1978 | Hilfiker . | |
| 4,343,571 | 8/1982 | Price | 405/284 |
| 4,374,798 | 2/1983 | Mercer . | |
| 4,421,439 | 12/1983 | ter Burg et al. . | |
| 4,756,645 | 7/1988 | Balzer | 405/258 X |
| 4,818,150 | 4/1989 | Jaecklin | 405/258 X |

FOREIGN PATENT DOCUMENTS

| | | | |
|---|---|---|---|
| 2626650 | 12/1977 | Fed. Rep. of Germany | 405/284 |
| 2167794 | 6/1986 | United Kingdom | 405/284 |

OTHER PUBLICATIONS

Article from *Civil Engineering*, ASCE, pp. 51–57, Jan. 1979.

Brochure entitled "Tensar® Soil Reinforcement Geogrid SR2".

Brochure entitled "Tensar®—Guidelines for the Design & Construction of Reinforced Soil Retaining Walls Using 'Tensar' Geogrids."

*Primary Examiner*—Dennis L. Taylor

*Attorney, Agent, or Firm*—Kilpatrick & Cody

[57] ABSTRACT

Woven geotextile grid for earth reinforcement applications. The grid is formed of woven fabric which is coated with a suitalbe polyvinylchloride or other plastic coating. The fabric is formed of a plurality of spaced-apart pick yarn bundles which are interwoven with a plurality of spaced-apart warp yarn bundles. The pick yarn bundles are held in place in the warp yarn bundles with locking yarns which run parallel to the pick yarns and which are positioned adjacent to the edges of the pick yarn bundles. The warp yarns extend between the pick yarn bundles and locking yarns to lock the pick yarn bundles into place. A plurality of pairs of leno yarns oriented parallel to the warp yarns additionally strenghten the fabric by interlocking with one another in the spaces between pick yarn bundles and locking yarns. The result is a grid which has wide lateral and longitudinal members that lock together to form large interstices through which soil and water may penetrate. Strength of the grid may be adjusted laterally or longitudinally by varying (1) the number, size and composition of pick yarns and warp yarms; (2) the spacing between pick yarn bundles and warp yarn bundles and (3) the number, position and composition of the leno yarns. Coatings may be independently formulated to suit particular applications without detracting from strength properties of the grid.

6 Claims, 3 Drawing Sheets

| | | | | | | | |
|---|---|---|---|---|---|---|---|
| 12 | X | | X | | X | | X |
| 11 | | X | | X | | X | X |
| 10 | | X | | X | | X | X |
| 9 | | X | | X | | X | X |
| 8 | | X | | X | | X | X |
| 7 | | X | | X | | X | X |
| 6 | | X | | X | | X | X |
| 5 | | X | | X | | X | X |
| 4 | | X | | X | | X | X |
| 3 | | X | | X | | X | X |
| 2 | | X | | X | | X | X |
| 1 | X | | X | | X | | X |

WOVEN GEOTEXTILE GRID

This application is a divisional application of pending application Ser. No. 07/280,123, filed Dec. 5, 1988.

The present invention relates to woven grids which are used for earth reinforcement applications. Such applications include embankments, soil slopes and retaining walls.

BACKGROUND OF THE INVENTION

Conventional methods of reinforcing earth include grading the substrate that supports the reinforced earth and adding additional layers of fill and perhaps other materials. The fill may be soil, crushed stone or waste. Such layers experience shear with respect to one another, particularly when the substrate is graded to a slope or is adjacent to a hillside. Efforts to compensate for and overcome such shear include use of various geotextile fabrics which absorb shear and also act as filters between layers. Conventional geotextile fabrics typically lack sufficient tensile strength to absorb great shear loads found in applications such as walls of waste pits, embankments, and applications on slopes, however.

One previous approach to forming a high-strength layer between fill layers in earth reinforcement applications is to install expanded plastic sheets. Such sheets are formed of relatively thick plastic typically two millimeters or greater in width. The sheets are alternately and periodically sliced and then pulled transverse to the slices to form a grid with diamondshaped interstices. The strength axis of such grids is parallel to the slices, and this axis is placed down-slope or in the direction in which strength is required. Such grids have proved to be expensive to manufacture, difficult to connect to adjacent grids, and otherwise difficult, labor intensive and expensive to package, transport and install, particularly in cold weather when the plastic stiffens.

SUMMARY OF THE INVENTION

Grids according to the present invention are formed of coated, woven fabric. A number of bundles of spaced-apart pick yarns are woven with a number of spaced-apart warp yarn bundles. Locking yarns oriented parallel and adjacent to the pick yarn bundles and placed on each side of those bundles help lock the pick yarn bundles into position with respect to the warp yarn bundles. Leno yarns found at either edge of the warp yarn bundles interlock between the pick yarn bundles and adjacent locking yarns further to lock pick yarn bundles and warp yarn bundles into place with respect to one another. This structure is coated with a desirable plastic material, preferably polyvinylchloride.

Grids according to this structure enjoy a number of advantages. First, such grids can be modified to accommodate various levels of tension and stress for various applications by changing the yarn size, number of pick and/or warp yarns, and yarn spacing in the material, simply by changing the loom setup. Such grids may thus be custom tailored for particular applications and installations with a minimum of expense and effort.

Grids according to the present invention can be manufactured for strength in one direction or both orthogonal directions. Such grids may thus employ smaller and more economical yarns in the non-strength direction. Grids of the present invention are very flexible. They may be folded, rolled, packaged and transported more easily and inexpensively than earlier thicker and stiffer plastic grids. Such grids can be installed with a minimum of expense and effort and stitched or stapled together on-site or during manufacture.

The pick yarn bundles of grids of the present invention have unexpectedly been found to rotate in the spaces between warp yarn bundles once the grid is embedded in the earth. Such rotation causes the pick yarn bundles to act as anchors in the strength direction of the grid, thus resulting in more effective soil stabilization and reinforcement.

Grids of the present invention may be coated with a desirable coating independent of strength considerations so that the coating may include antimicrobials, fungicides, ultraviolet stabilizers or other desirable materials substantially without concern over the effects of such components on the strength of the grid, which is determined by the yarn size, structure and spacing. Coatings may therefore be chosen to allow the grids to be highly resistent to abrasion from earth-moving equipment, oils, solvents, acids, bases and bacteria, with a minimum of expense and a minimum of concern regarding the effects of the coating formulation on the grid strength.

Finally, grids according to the present invention can be manufactured on looms which are utilized for other types of fabric such as belting fabric, and which may otherwise be idle, thus decreasing the overhead in production costs. It has been found, for instance, that such grids are cost competitive with conventional expanded plastic sheet grids.

It is therefore an object of the present invention to provide geotextile grids which may be used for high strength earth reinforcement applications such as embankments, soil slopes and retaining walls.

It is an additional object of the present invention to provide woven geotextile grids which are competitive in cost with other conventional grids and which are easy and inexpensive to package, transport and install.

It is an additional object of the present invention to provide woven grids comprising a plurality of spaced-apart bundles of warp and pick yarns to form a structure whose strength and durability characteristics may easily be optimized for particular applications by changing yarn size and composition, number of yarns and yarn spacing in the material, as well as coating formulation.

Other objects, features and advantages of the present invention will become apparent with reference to the remainder of this document.

DETAILED DESCRIPTION OF THE DRAWINGS

Figures 1, 2:
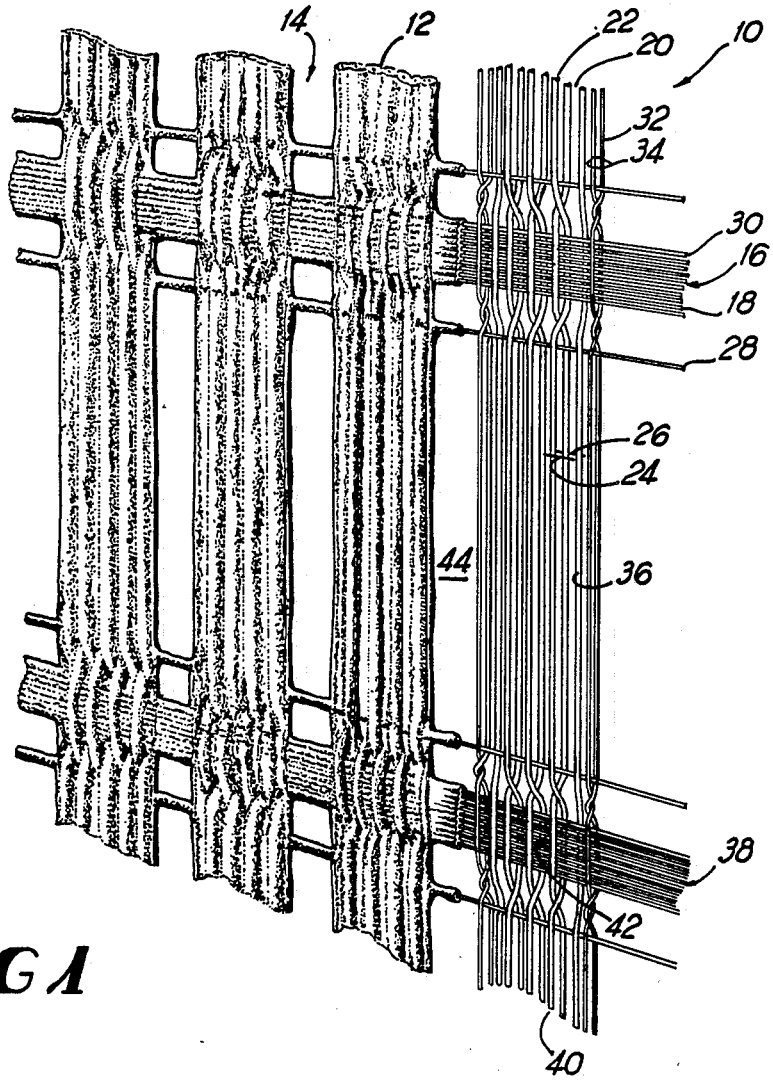
FIG. 1 is a perspective view of a grid according to the present invention.
FIG. 2 is a pick diagram showing loom settings for forming the grid of FIG. 1.

FIG. 1 shows fabric 10 which is coated with coating 12 to form a grid 14 of the present invention. Fabric 10 is formed of a number (plurality) of spaced-apart pick yarn bundles 16. Each pick yarn bundle is in turn formed of a number of pick yarns 18. The pick yarn bundles 16 are woven together with a number of spaced-apart warp yarn bundles 20, each of which is formed of a number of warp yarns 22. Pick yarn bundles 16 form a first side 24 and a second side 26 of grid 14.

Fabric of the present invention may be formed on any desired programmable loom. A modified Pignone loom has proven to be successful. FIG. 2 is a pick diagram for a warp yarn bundle of FIG. 1 which comprises eight warp yarns. The loom lifts alternate warp yarns in the bundle as the first locking yarn 28 is thrown. It then reverses the warp yarns 22 which are lifted for the next 10 pick yarns 18. The second locking yarn 28 is thrown as the original warp yarns 22 are once again lifted. Locking yarns 28 slide away from the pick yarns 18 in pick yarn bundle 16 as the fabric is formed. The loom then throws 60 false picks in the preferred embodiment for a complete cycle of 72 picks.

The weaving scheme shown in FIG. 2 positions warp yarns 22 in each warp yarn bundle 20 on opposite sides of pick yarn bundles 16, as shown in FIG. 1. It also incorporates locking yarns 28 into fabric 10. Without additional lateral yarns in fabric 10, pick yarn bundles 16 would slide up and down in warp yarn bundles 20. Locking yarns 28 for each pick yarn bundle 16, however, help lock pick yarn bundles 16 into place. Each locking yarn 28 is positioned adjacent to an edge pick yarn 30 in a pick yarn bundle 16 so that alternate warp yarns 22 in warp yarn bundles 20 extend between locking yarns 28 and pick yarn bundles 16. A warp yarn 22 that is positioned on first side 24 of pick yarn bundle, 16, for instance, crosses over and is positioned on second side 26 of locking yarns 28 that correspond to the pick yarn bundle 16.

Fabric 10 also includes a plurality of leno yarns which help stabilize pick yarn bundles 16 and warp yarn bundles 20 with respect to each other. Leno yarns are positioned in fabric 10 in pairs 34, and leno yarns 32 in a pair cooperate with one another to stabilize fabric 10. Leno yarn pairs 34 may be placed at any desirable location in fabric 10. In the embodiment shown in FIG. 1, pairs 34 are placed adjacent to edge warp yarns 36 of warp yarn bundles 20. Leno yarns 32 are positioned on opposite sides of pick yarn bundles 16. They interlock with one another between pick yarn bundles 16 and locking yarns 28 and extend across the same side of locking yarns 28 that they are positioned with respect to pick yarn bundles 16. Leno yarn pairs 34 may also be placed in the middle of warp yarn bundles 20 or wherever else desired.

Such fabric according to the present invention thus forms a grid 14 which has wide lateral members 38 (pick yarn bundles 16) and longitudinal members 40 (wrap yarn bundles 20) which interconnect at nodes 14 to define large interstices 44 through which soil, water or other material may pass when the grid 14 is in situ.

A preferred form of fabric of the present invention is formed of six-ply, 1,000 denier-twisted polyester pick yarns 18, warp yarns 22 and locking yarns 28. Polyester is preferred because of its high tensile strength, low elongation properties and high melt temperature. Polypropylene yarns may also be used, as well as any other synthetic (or non-synthetic) yarns having appropriate properties, however. Leno yarns are preferably single-ply, 1,300 denier polyester filaments in the embodiment shown in FIG. 1. Filaments or yarns of other suitable composition may be used as alternatives.

The number of pick yarns 18, warp yarns 22 and leno yarns 32 may be changed to make fabric 10 and grid 14 stronger or weaker in the latitudinal and/or longitudinal directions. Different yarn sizes and compositions may also be used, and the pick yarn bundles 16 and warp yarn bundles 20 may be spaced closer together or farther apart for particular applications.

The fabric 10 is coated after it leaves the loom. It is preferably dipped in a heated polyvinylchloride bath and dried using heating elements before being rolled for storage or shipment. Latex, urethane or polyethylene coatings could also be used. Polyvinylchloride is particularly desirable because it locks the fabric weave and because it is highly resistant to acids and water and thus protects the yarns. Polyvinylchloride has also been found to adhere particularly effectively to the polyester yarns which are used in the preferred form of fabric 10. Antimicrobials, fungicides and ultraviolet stabilizers may be added to the polyvinylchloride or other coatings as desired for particular applications.

The resultant fabric is particularly desirable for earth reinforcement applications because of its unidirectionally controllable strength characteristics, excellent anchoring properties and large interstices through which liquids and solids may easily migrate. The pick yarn bundles 16 unexpectedly have been found to rotate when grid 14 is in place, so that the anchoring properties of grid 14 are greatly enhanced in the warp yarn direction. This property, combined with the fact that each warp yarn bundle 20 acts as a separate dead-man or anchor reduces the weight and volume of soil required to anchor grid 14. Retaining walls anchored by grids according to the present invention can thus be anchored with fewer cubic feet of soil. The angle of repose for embankments reinforced by grids of the present invention can be greater for similar reasons.

Figure 3:
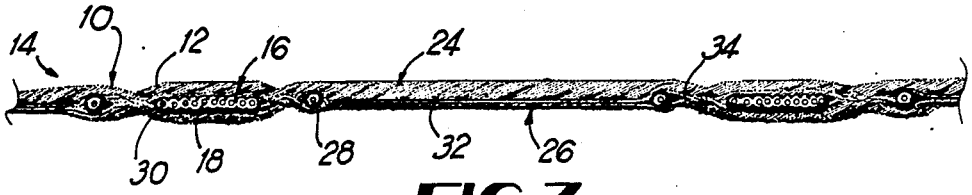
FIG. 3 is a cross-sectional view taken along a line parallel to warp yarns in the grid of FIG. 1.

FIG. 3 shows a cross sectional view of grid 14 of FIG. 1. Locking yarns 28 and pick yarns 18 can be seen extending from coating 12 and leno yarns 32.

Figure 6:
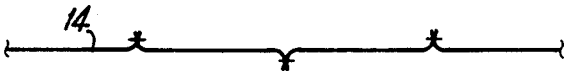
FIG. 6 is a schematic view showing sections of woven grid of the present invention whose edges are fastened together.
Figure 7:
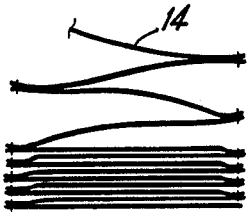
FIG. 7 is a schematic view showing how edges of adjacent sections of grids of the present invention may easily be stitched together.
Figure 8A:
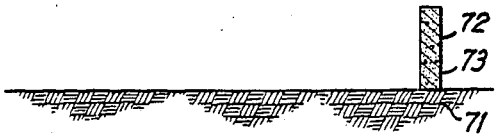
FIGS. 8A–8F show steps in forming a retaining wall using grid according to the present invention.
Figure 8B:
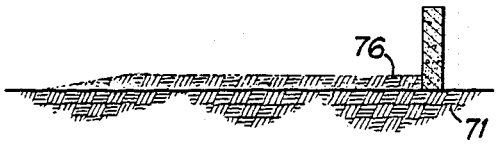
Figure 8C:
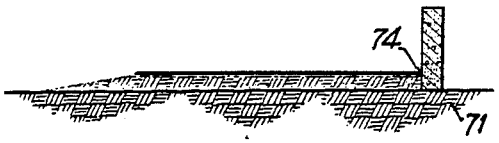
Figure 8D:
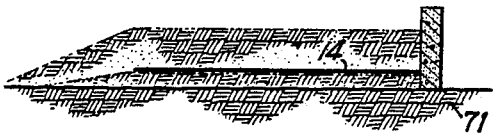
Figure 8E:
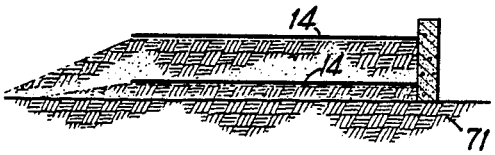
Figure 8F:
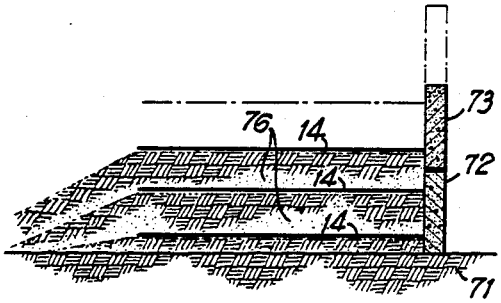

FIGS. 6 & 7 show how sheets of grid 14 of the present invention may be stacked atop one another so that their edges can be easily stitched or stapled together during manufacture or on-site. The sheets may then be pulled apart to form a continuous grid 14 as shown in FIG. 6.

Figure 4:
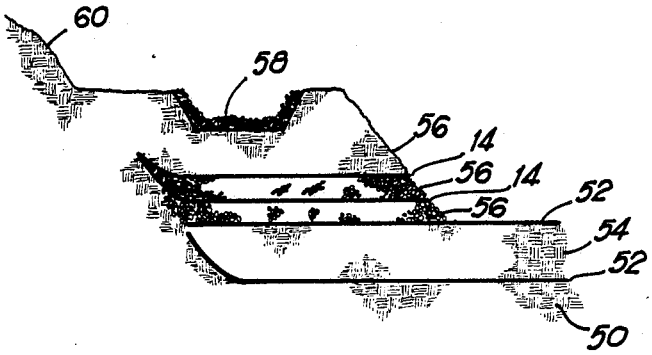
FIG. 4 is a cross-sectional view of a drainage channel reinforced by grids according to the present invention.

FIG. 4 shows a drainage channel which is reinforced by grid 14 according to the present invention. Substrate 50 which will support the channel is graded to a desired height and slope and a layer of geotextile 52 may be placed on substrate 50. A layer of fill 54 is then placed on geotextile 52 and graded to desired height and slope. Another geotextile layer 52 may be placed atop fill 54 to assist in filtering and stabilization. An additional layer of fill 56 is placed atop the second geotextile layer and graded to desired height and slope. Woven grid 14 of the present invention is then placed atop fill 56 and covered with another layer of fill 56. A second layer of woven grid 14 may be added and covered with an additional fill layer 56 in which the lined channel 58 may be formed. Fill layers 54 and 56 may be soil, crushed stone or other desired materials. The structure of FIG. 4 resists shear forces placed on it by adjacent hillside 60, which tends to force the structure downhill and wash it away from the hillside.

Figure 5:
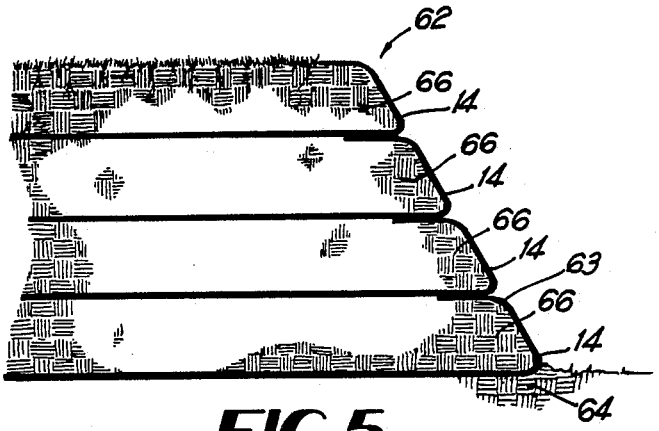
FIG. 5 is a cross-sectional view of an embankment formed by grids according to the present invention.

FIG. 5 shows an embankment 62 formed using woven grid 14 of the present invention. Substrate 64 which will support the embankment is graded to a desired and predetermined height and slope and then covered with a first layer of woven grid 14. Portions of grid 14 of predetermined size which will form the wall or walls 63 of embankment 62 are left uncovered as fill layer 66 is placed atop grid 14. Fill layer 66 is graded to a desired height, slope and area corresponding to the dimensions of the embankment at the height of fill layer 66. Uncovered portions of grid 14 are then wrapped up and over fill 66. Fill layer 66 is then covered with an additional layer of grid 14 which is covered with an additional fill layer 66. The process is repeated until the desired height is reached. The last layer of grid 14 may be completely covered with the top fill layer 66, or it may once again extend around the walls of fill layer 66 and overlie a portion of the top of embankment 62 or be partially or fully covered by fill 66. Embankments 62 so formed can have a steeper angle of repose than embankments which are not reinforced. Flexibility of grids 14 according to the present invention, unlike earlier plastic grids, allow then to be wrapped around fill layers 66 to form the walls of embankment 62 as shown in FIG. 5.

Figure 9:
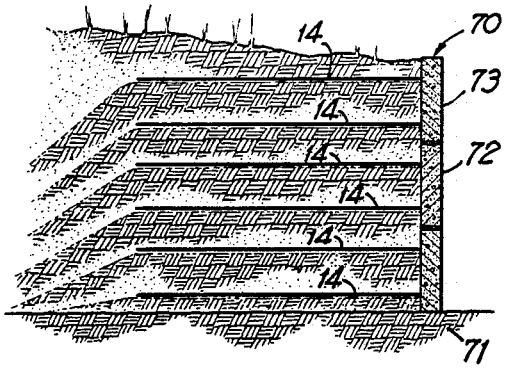
FIG. 9 is a cross-sectional view of a retaining wall formed according to the method shown in FIGS. 8A–8F.
Figure 10:
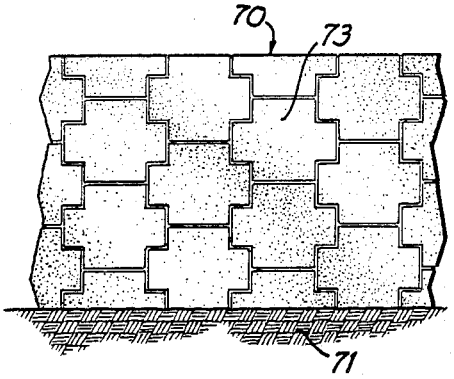
FIG. 10 is a front view of a retaining wall formed according to the method shown in FIGS. 8A–8F.

FIGS. 8, 9 and 10 show construction and appearance of a retaining wall 70 formed using grids 14 of the present invention. Substrate 71 which will support the wall is graded to a desired height and slope and a first layer of retaining wall elements 72 is placed atop substrate 71. Each retaining wall element 73 of a retaining wall elements layer 72 has at least one fastener 74 for attachment to grid 14 of the present invention. A layer of fill is added to substantially the height of the lowest fasteners on the first retaining wall elements layer 72. Lengths of grid 14 are attached to the fasteners 72 as shown in FIG. 8C and the grid is covered with an additional fill layer 76. Fill layer 76 is graded to a height of substantially the next higher set of fasteners 74 (if any) on retaining wall elements layer 72 as shown in FIG. 8D and additional lengths of grid 14 are attached to fasteners 73 as shown in FIG. 8E. A second layer of retaining wall elements 72 is placed atop the first layer and this process is repeated until the retaining wall 70 is formed. FIG. 9 shows a cross-sectional view of a retaining wall 70 formed using grid 14, and FIG. 10 shows a front view of the wall 70.

Grids 14 may likewise be used in other applications where soil or earth structures must be reinforced. The foregoing examples of structure, manufacture and use of grids 14 are for purposes of explanation and illustration. Modifications and enhancements may be made without departing from the scope or spirit of the invention.

What is claimed is:

1. A method of reinforcing earth, comprising the steps of:

(a) providing a woven grid, comprising:

(i) a plurality of spaced-apart bundles of pick yarns positioned adjacent to one another and forming a first and a second side of the grid;

(ii) a plurality of pairs of locking yarns oriented parallel to the pick yarns, each yarn in a locking yarn pair positioned adjacent to an edge of a pick yarn bundle;

(iii) a plurality of spaced-apart bundles of warp yarns positioned adjacent to one another, alternately positioned on the first and second sides of the pick yarn bundles and extending between each pick yarn bundle and its corresponding locking yarns;

(iv) a plurality of pairs of leno yarns oriented parallel to the warp yarns, the leno yarns in each pair positioned on opposite sides of the pick yarn bundles and interlocking with each other between each pick yarn bundle and its corresponding locking yarns; and (v) a plastic coating covering the yarns;

(b) grading to a predetermined height and slope an area of substrate that will support the reinforced earth;

(c) placing a layer of the woven grid on the graded fill in a direction such that the pick yarn bundles and locking yarns are oriented substantially perpendicular to the direction of the grade, the pick yarn bundles acting as anchors and the locking yarns helping lock the pick yarn bundles and the warp yarn bundles into place, and the warp yarn bundles and leno yarns are oriented substantially parallel to the direction of the grade, the warp yarn bundles acting as strength members and the leno yarns helping lock the pick yarn bundles and the warp yarn bundles into place;

(d) placing a layer of fill on the grid; and (e) grading the layer of fill to a predetermined height and slope.

2. A method of reinforcing earth according to claim 1, comprising the additional step of repeating steps (c)–(e) at least once.

3. A method of reinforcing earth according to claim 2 in which at least one layer of fill comprises crushed stone.

4. A method of forming an embankment, comprising the steps of:

(a) providing a woven grid, comprising:

(i) a plurality of spaced-apart bundles of pick yarns positioned adjacent to one another and forming a first and a second side of the grid;

(ii) a plurality of pairs of locking yarns oriented parallel to the pick yarns, each yarn in a locking yarn pair positioned adjacent to an edge of a pick yarn bundle;

(iii) a plurality of spaced-apart bundles of warp yarns positioned adjacent to one another, alternately positioned on the first and second sides of the pick yarn bundles and extending between each pick yarn bundle and its corresponding locking yarns;

(iv) a plurality of pairs of leno yarns oriented parallel to the warp yarns, the leno yarns in each pair positioned on opposite sides of the pick yarn bundles and interlocking with each other between each pick yarn bundle and its corresponding locking yarns; and (v) a plastic coating covering the yarns;

(b) grading to a predetermined height and slope an area of substrate that will support the embankment;

(c) placing a layer of the woven grid on the graded substrate in a direction such that the pick yarn bundles and locking yarns are oriented substantially perpendicular to the direction of the grade, the pick yarn bundles acting as anchors and the locking yarns helping lock the pick yarn bundles and the warp yarn bundles into place, and the warp yarn bundles and leno yarns are oriented substantially parallel to the direction of the grade, the warp yarn bundles acting as strength members and the leno yarns helping lock the pick yarn bundles and the warp yarn bundles into place;

(d) placing a layer of fill on a portion of the woven grid corresponding to the cross-sectional area of the embankment to be formed by the fill, but leaving a predetermined portion of the woven grid uncovered;

(e) grading the layer of fill to a predetermined height, slope and area;

(f) wrapping the uncovered edges of the woven grid up around the fill from which the grid extends;

(g) placing an additional layer of the woven grid on the graded fill in a direction such that the pick yarn bundles and locking yarns are oriented substantially perpendicular to the direction of the grade, the pick yarn bundles acting as anchors and the locking yarns helping lock the pick yarn bundles and the warp yarn bundles into place, and the warp yarn bundles and leno yarns are oriented substantially parallel to the direction of the grade, the warp yarn bundles acting as strength members and the leno yarns helping lock the pick yarn bundles and the warp yarn bundles into place;

(h) placing an additional layer of fill on a portion of the woven grid corresponding to the cross-sectional area of the embankment to be formed by the additional layer of fill, but leaving a predetermined portion of the additional layer of woven grid uncovered;

(i) grading the additional layer of fill to a predetermined height, slope and area;

(j) wrapping the uncovered portions of the woven grid up around the fill from which the grid extends;

(k) placing an additional layer of fill on the embankment; and (l) grading the additional layer of fill on a predetermined height, slope and area.

5. A method of forming an embankment according to claim 4 further comprising repeating steps (g)–(j) at least once.

6. A method of forming an earth retaining wall, comprising the steps of:

(a) providing a woven grid, comprising:

(i) a plurality of spaced-apart bundles of pick yarns positioned adjacent to one another and forming a first and a second side of the grid;

(ii) a plurality of pairs of locking yarns oriented parallel to the pick yarns, each yarn in a locking yarn pair positioned adjacent to an edge of a pick yarn bundle;

(iii) a plurality of spaced apart bundles of warp yarns positioned adjacent to one another, alternately positioned on the first and second sides of the pick yarn bundles and extending between each pick yarn bundle and its corresponding locking yarns;

(iv) a plurality of pairs of leno yarns oriented parallel to the warp yarns, the leno yarns in each pair positioned on opposite sides of the pick yarn bundles and interlocking with each other between each pick yarn bundle and its corresponding locking yarns; and (v) a plastic coating covering the yarns;

(b) providing a plurality of retaining wall elements, each element having at least one fastener for attachment to a length of woven grid;

(c) grading to a predetermined height and slope an area of substrate that will support the wall and the earth it retains;

(d) placing a layer of retaining wall elements on the graded substrate;

(e) placing a layer of fill on the substrate;

(f) grading the layer of fill to substantially the height of the lowest fasteners on the retaining wall elements;

(g) attaching at least one length of woven grid to at least one lowest fastener on each retaining wall element in a direction such that the pick yarn bundles and locking yarns are oriented substantially perpendicular to the retaining wall, the pick yarn bundles acting as anchors and the locking yarns helping lock the pick yarn bundles and the warp yarn bundles into place, and the warp yarn bundles and leno yarns are oriented substantially parallel to the retaining wall, the warp yarn bundles acting as strength members and the leno yarns helping lock the pick yarn bundles and the warp yarn bundles into place;

(h) placing an additional layer of fill on the lengths of woven grids;

(i) grading the additional layer of fill to substantially the height of the next-higher fasteners on the retaining wall elements;

(j) attaching at least one length of woven grid to at least one next-higher fastener in a direction such that the pick yarn bundles and locking yarns are oriented substantially perpendicular to the retaining wall, the pick yarn bundles acting as anchors and the locking yarns helping lock the pick yarn bundles and the warp yarn bundles into place, and the warp yarn bundles and leno yarns are oriented substantially parallel to the retaining wall, the warp yarn bundles acting as strength members and the leno yarns helping lock the pick yarn bundles and the warp yarn bundles into place;

(k) placing an additional layer of retaining wall elements on the highest layer of retaining wall elements in place;

(l) placing an additional layer of fill on the lengths of woven grids;

(m) repeating steps f–l at least once; and (n) grading the additional layer of fill to a predetermined height and slope.

* * * * *